US005358575A

United States Patent [19]

Nakagawa et al.

[11] Patent Number: 5,358,575

[45] Date of Patent: Oct. 25, 1994

[54] METHOD FOR BLACKENING NI-FE SHADOW MASK AND MESH BELT TYPE BLACKENING LEHR FOR CARRYING OUT THE METHOD

[75] Inventors: Hiroshige Nakagawa, Sakurai; Shigeo Yamamoto, Tondabayashi; Motokazu Ikeuchi, Nara; Yoshinori Yoshimura, Toyonaka, all of Japan

[73] Assignee: Chugai Ro Company, Limited, Osaka, Japan

[21] Appl. No.: 854,856

[22] Filed: Mar. 20, 1992

[30] Foreign Application Priority Data

Apr. 3, 1991 [JP] Japan ..... 3-070824

[51] Int. Cl.[5] ..... C23C 8/10; H01J 9/14

[52] U.S. Cl. ..... 148/287; 65/349

[58] Field of Search ..... 148/287

[56] References Cited

U.S. PATENT DOCUMENTS 3,617,394 11/1971 Mayers ..... 148/287
4,448,612 5/1984 Ebert ..... 148/287
4,769,089 9/1988 Gary ..... 148/287

FOREIGN PATENT DOCUMENTS 475228 7/1951 Canada .
2532108 2/1984 France ..... 148/287

*Primary Examiner*—Sam Silverberg
*Attorney, Agent, or Firm*—Birch, Stewart, Kolasch & Birch

[57] ABSTRACT

A mesh belt type blackening lehr comprising: a discharge duct provided at a predetermined position of a ceiling of a blackening zone, the temperature of which is kept at a blackening temperature. The blackening zone is divided into a charge side region and a discharge side region. The charge side region is kept in an atmosphere of mixture gas of air and humidification exothermic type gas so as to perform first processing for forming an oxide film consisting of $Fe_2O_3$, $Fe_3O_4$, and FeO. The discharge side region is kept in an atmosphere of humidification exothermic type gas so as to perform second processing for reducing $Fe_2O_3$. Thus, an oxide film, consisting of mainly $Fe_3O_4$, is formed on the surface of the shadow mask.

2 Claims, 1 Drawing Sheet

METHOD FOR BLACKENING NI-FE SHADOW MASK AND MESH BELT TYPE BLACKENING LEHR FOR CARRYING OUT THE METHOD

BACKGROUND OF THE INVENTION

1. Field of the Invention

The present invention relates to a method for blackening a Ni-Fe shadow mask and a mesh belt type blackening lehr.

2. Description of the Related Arts

Blackening processing, namely, processing for forming an oxide film on the surface of a shadow mask of a cathode ray tube for use in a color television is performed to improve a heat diffusion and prevent the shadow mask from being rusted.

Conventionally, blackening processing is carried out in an atmosphere of humidification exothermic type gas or an atmosphere of mixture gas of air and humidification exothermic type gas.

In the conventional blackening processing, if the shadow mask is made of aluminum killed steel, an oxide film having a desired radiation coefficient can be formed, but the aluminum killed steel has a great coefficient of thermal expansion and thus, is unsuitable as a material of the shadow mask of a cathode ray tube for use in a color television because the shadow mask has a great radius of curvature. Instead of the aluminum killed steel, Invar material of Ni-Fe is used as a material of a shadow mask because it has a small coefficient of thermal expansion. Since it is difficult to oxidize the Invar material because it contains Ni, so that the blackening processing does not provide a sufficient radiation coefficient.

In blackening a shadow mask of 36% Ni-Fe at a temperature of 600° C. for 20 to 30 minutes, a light brown or purple brown oxide film having a radiation coefficient of 0.32 to 0.38 is obtained in an atmosphere of humidification exothermic type gas and a blue ash oxide film having a radiation coefficient of 0.45 to 0.6 is obtained in a mixture gas of air and humidification exothermic type gas. A film of $Fe_2O_3$ is formed on the surface layer of an oxide film in both cases.

SUMMARY OF THE INVENTION

It is therefore an object of the present invention to provide a method for blackening a Ni-Fe shadow mask, namely, forming an oxide film having a favorable radiation coefficient on the surface thereof in a short period of time and a mesh belt type blackening lehr for carrying out the method.

In accomplishing these and other object, there is provided a method for blackening a Ni-Fe shadow mask comprising: first processing for forming an oxide film consisting of $Fe_2O_3$, $Fe_3O_4$, and FeO; and second processing for reducing $Fe_2O_3$ so that an oxide film, consisting of mainly $Fe_3O_4$, is formed on the surface of the shadow mask.

The first processing is performed in an atmosphere of mixture gas of air and humidification exothermic type gas and second processing is performed in an atmosphere of humidification exothermic type gas.

A mesh belt type blackening lehr according to the present invention comprises: a discharge duct provided at a predetermined position of a ceiling of a blackening zone, the temperature of which is kept at a blackening temperature so as to divide the blackening zone into a charge side region and a discharge side region. In this construction, air and humidification exothermic type gas are supplied to the charge side region, and humidification exothermic type gas is supplied to the discharge side region and a cooling zone.

According to the above-described construction, $Fe_2O_3$ is formed on the surface layer of an oxide film and $Fe_2O_3$ is reduced to $Fe_3O_4$. Thus, the oxide film consisting of mainly $Fe_3O_4$ can be formed on the surface of the shadow mask and in addition, granular convexes/concaves are formed on the surface layer of the oxide film due to the reduction. Consequently, light can be absorbed favorably and radiation coefficient is improved.

Further, since the shadow mask is forcibly oxidized, processing (oxidizing) period of time can be reduced and a favorable oxide film can be formed. Thus, radiation coefficient does not decrease in the subsequent process.

According to the mesh belt type blackening lehr, since the discharge duct provided between the first and second processings of the blackening processing zone discharges the atmosphere therein. Thus, the atmosphere of the lehr can be separated from each other as desired although the shadow mask is transported by a mesh belt conveyor. Therefore, a film Containing components uniformly contained can be formed on the surface of the shadow mask and the lehr can be simplified in its construction.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
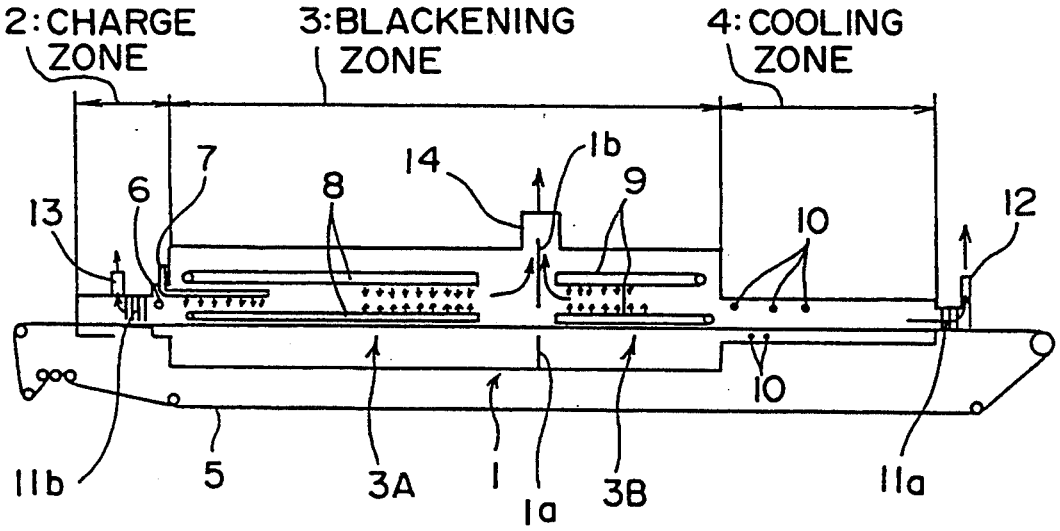
FIG. 1 is a front sectional view of a mesh belt type blackening lehr in accordance with the present invention.

Before the description of the present invention proceeds, it is to be noted that like parts are designated by like reference numerals throughout the accompanied drawings.

A method for blackening a Ni-Fe shadow mask in accordance with the present invention and a mesh belt type blackening lehr for carrying out the method will be described below with reference to FIGS. 1 and 2.

Referring to FIG. 1, a mesh belt type blackening lehr 1 comprises a charge zone 2; a blackening zone 3; and a cooling zone 4. A mesh belt 5 is provided in the lehr 1.

The blackening zone 3 is divided into a charge side region 3A and a discharge side region 3B by a pair of partitioning walls **1*a* and 1*b* being provided adjacent to a discharge duct 14 provided on the ceiling of the lehr 1. There are provided in the charge side region 3A a supply pipe 6 for supplying humidification exothermic type gas having a dew point of 45° C. to 60° C., an air supply pipe 7, and a supply pipe 8 for supplying mixture gas of air and the humidification exothermic type gas. A supply pipe 9 for supplying the humidification exothermic type gas is provided in the discharge side region 3B. Thus, the charge side region 3A is kept to be an atmosphere of mixture gas of air and the humidification exothermic type gas, and the discharge side region 3B is kept to be an atmosphere consisting of the humidification exothermic type gas. A fixed type lower partitioning wall 1***a* and an elevation type upper partitioning wall 1*b* are provided in the blackening zone 3.

The cooling zone 4 comprises supply pipes 10 for supplying the humidification exothermic type gas and a discharge duct 12 provided downstream of a sealing curtain 11*a*. The charge zone 2 comprises a discharge duct 13 provided upstream of a sealing curtain 11*b*.

The atmosphere in the blackening zone 3 is discharged mainly from the discharge duct 14 so that the atmosphere of the charge side region 3A and the discharge side region 3B do not mix with each other. A part of the atmosphere of the charge side region 3A is discharged from the discharge duct 13 of the charge zone 2, and a part of the atmosphere of the discharge side region 3B passes through the cooling zone 4 and is discharged from the discharge duct 12 provided downstream of the cooling zone 4.

The blackening processing in accordance with the present invention is described below.

Figure 2:
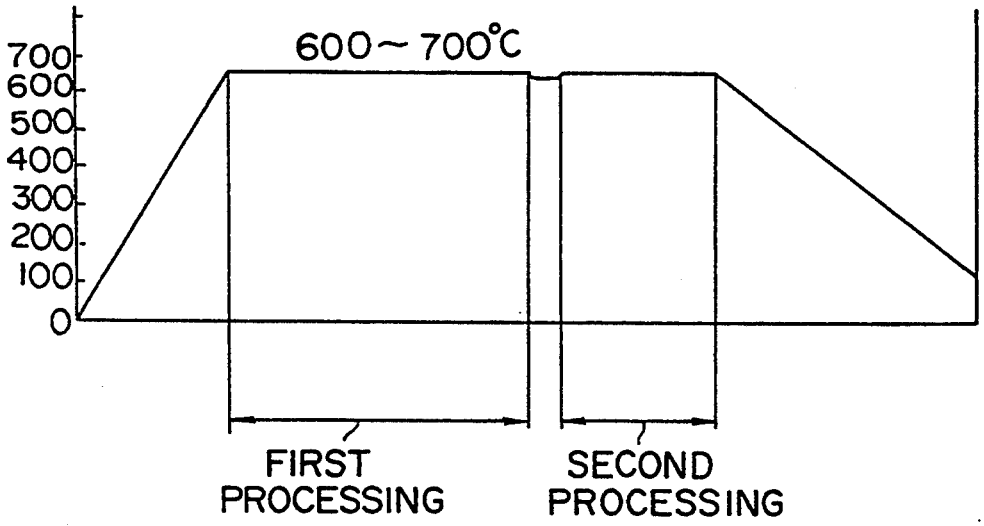
FIG. 2 is a graph showing the temperature of each zone of the mesh belt type blackening lehr.

As shown in FIG. 2, the Ni-Fe shadow mask placed on the mesh belt 5 at the entrance of the lehr 1 is preheated in the charge zone 2 and is then fed to the blackening zone 3, the temperature of which is kept at 600° C. to 700° C. While the shadow mask is passing through the charge side region 3A in 10 to 20 minutes, it is heated in the atmosphere of mixture gas of air and the humidification exothermic type gas, the dew point of which is 45° C. to 60° C. As a result, an oxide film consisting of $Fe_2O_3$ (surface layer), $Fe_3O_4$, and FeO is formed (first processing.)

Then, the shadow mask is fed to the discharge side region 3B. While it is passing through the discharge side region 3B in 10 to 20 minutes, it is heated in the atmosphere of the humidification exothermic type gas, namely, in the oxidizing atmosphere in which only $Fe_3O_4$ is formed on the surface of the shadow mask and $Fe_2O_3$ formed in the first processing is reduced to form $Fe_3O_4$ (second processing.) After the blackening processing is completed, the shadow mask passes the cooling zone 4 in which it is cooled to a predetermined temperature. Then, the shadow mask is discharge from the cooling zone 4.

Processing conditions and results of embodiments conducted in different processing conditions are shown below.

EMBODIMENT 1

Processing condition
material: shadow mask of 36% Ni-Fe
blackening temperature: 630° C.
blackening period of time:
first processing: 20 minutes
second processing: 10 minutes
supplied atmosphere gas:
first processing:
humidification exothermic type gas: (D;P: 49° C.) 155 $Nm^3/Hr$
air: 15$Nm^3/Hr$
second processing:
humidification exothermic type gas: (D;P: 49° C.) 150 $Nm^3/Hr$
Result
film color: black purple
radiation coefficient: 0.73

EMBODIMENT 2

Processing condition
blackening temperature: 650° C.
supplied atmosphere gas:
first processing:
humidification exothermic type gas: (D;P: 47° C.) 120 $Nm^3/Hr$
air: 15 $Nm^3/Hr$
second processing:
humidification exothermic type gas: (D;P: 47° C.) 120 $Nm^3/Hr$ Other processing conditions are the same as those of embodiment 1.

Result
film color: black purple
radiation coefficient: 0.68

EMBODIMENT 3

Processing condition
blackening temperature: 650° C.
supplied atmosphere gas:
first processing:
humidification exothermic type gas: (D;P: 49° C.) 190 $Nm^3/Hr$
air: 15$Nm^3/Hr$
second processing:
humidification exothermic type gas: (D;P: 49° C.) 190 $Nm^3/Hr$ Other processing conditions are the same as those of embodiment 1.

Result
film color: black purple
radiation coefficient: 0.70

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method for blackening a Ni-Fe shadow mask comprising the steps of:

first, forming an oxide film consisting essentially of $Fe_2O_3$, $Fe_3O_4$, and FeO on the surface of said shadow mask, in an atmosphere of a mixture of air and a humidification exothermic gas at a temperature of 600° to 700° C. for 10 to 20 minutes; and second, reducing said $Fe_2O_3$ in an atmosphere of humidification exothermic type gas at a temperature of 600° to 700° C. for 10 to 20 minutes to form an oxide film of mainly $Fe_3O_4$ on the surface of said shadow mask.

2. The method for blackening a Ni-Fe shadow mask according to claim 1, wherein the dew point of the humidification exothermic gas is 45° C. to 60° C.

* * * * *